US006829445B2

(12) United States Patent
Inukai

(10) Patent No.: US 6,829,445 B2
(45) Date of Patent: Dec. 7, 2004

(54) IMAGE FORMING APPARATUS HAVING A CLEANING MECHANISM FOR CLEANING A PHOTOSENSITIVE MEMBER

(75) Inventor: Katsumi Inukai, Iwakura (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/394,218

(22) Filed: Mar. 24, 2003

(65) Prior Publication Data

US 2003/0185582 A1 Oct. 2, 2003

(30) Foreign Application Priority Data

Mar. 29, 2002 (JP) ..... 2002-093885

(51) Int. Cl.[7] ..... G03G 15/00

(52) U.S. Cl. ..... 399/46; 399/71; 399/354

(58) Field of Search ..... 15/1.51, 256.51, 15/256.52; 399/46, 50, 71, 352, 353, 354, 356, 357, 358, 359, 360

(56) References Cited

U.S. PATENT DOCUMENTS

| | | | | |
|---|---|---|---|---|
| 4,296,423 A | | 10/1981 | Nakamura | |
| 4,956,677 A | * | 9/1990 | Akiyama | 399/46 |
| 5,822,657 A | | 10/1998 | Hisada et al. | |
| 6,304,735 B1 | | 10/2001 | Nishimura et al. | |

FOREIGN PATENT DOCUMENTS

| | | |
|---|---|---|
| JP | 55-28010 | 2/1980 |
| JP | 4-69677 | 3/1992 |
| JP | 4-171463 | 6/1992 |
| JP | 4-335693 | 11/1992 |
| JP | 5-19594 | 1/1993 |
| JP | 5-45958 | 2/1993 |
| JP | 5-61383 | 3/1993 |
| JP | 6-214442 | 8/1994 |
| JP | 6-308865 | 11/1994 |
| JP | A 8-262943 | 10/1996 |
| JP | 9-90840 | 4/1997 |
| JP | 9-127844 | 5/1997 |
| JP | A 9-204126 | 8/1997 |
| JP | A 9-319276 | 12/1997 |
| JP | A 9-330002 | 12/1997 |
| JP | 9-330003 | 12/1997 |
| JP | A 2001-13840 | 1/2001 |

OTHER PUBLICATIONS

U.S. patent application Ser. No. 10/224,394, Takami et al., filed Aug. 21, 2002.

* cited by examiner

*Primary Examiner*—Hoang Ngo
(74) *Attorney, Agent, or Firm*—Oliff & Berridge, PLC

(57) ABSTRACT

An image forming apparatus including a photosensitive member that holds an image formed by a developing agent, a charging device that charges a surface of the photosensitive member, a voltage applying device that applies a voltage to the charging device, a first cleaning element that contacts the surface of the photosensitive member, a second cleaning element that contacts a surface of the first cleaning member, and a first voltage controlling device, connected to the charging device, the first cleaning element and the second cleaning element, that generates a predetermined potential difference between the first cleaning element and the second cleaning element based on the voltage applied to the charging device.

20 Claims, 10 Drawing Sheets

IMAGE FORMING APPARATUS HAVING A CLEANING MECHANISM FOR CLEANING A PHOTOSENSITIVE MEMBER

BACKGROUND OF THE INVENTION

1. Field of Invention

The invention relates to an image forming apparatus having a device for removing foreign matter adhered onto a photosensitive member.

2. Description of Related Art

In an image forming apparatus such as a laser printer or a copying device, a cleaning device of a cleanerless type has been known. In the cleaning device of the cleanerless type, toner that is not transferred onto paper and remains on the photosensitive drum is returned to a developer. Therefore, the cleaning device of the cleanerless type does not require a cleaning device for cleaning the photosensitive drum such as a cleaning blade or a storing device for storing toner that is removed.

In the cleaning device of the cleanerless type, the toner remaining on the photosensitive drum is collected temporally by a cleaning roller, and the collected toner is discharged onto the photosensitive drum and collected by the developer when an image forming operation is not carried out. The cleaning roller is formed of a conductive elastic member and arranged so as to be rotated and in contact with the photosensitive drum. By applying an electric potential difference between the cleaning roller and the photosensitive drum, the remaining toner on the photosensitive drum is electrically attracted and collected when the image forming operation is carried out, and the electric potential difference between the cleaning roller and the photosensitive drum is reversed and the collected toner is discharged onto the photosensitive drum when the image forming operation is not carried out.

SUMMARY OF THE INVENTION

The invention is directed to an image forming apparatus having a device for removing foreign matter adhered onto a photosensitive member. The image forming apparatus according to a first exemplary aspect includes a photosensitive member that holds an image formed by a developing agent, a charging device that charges a surface of the photosensitive member, a voltage applying device that applies a voltage to the charging device, a first cleaning element that contacts the surface of the photosensitive member, a second cleaning element that contacts a surface of the first cleaning member, and a first voltage controlling device, connected to the charging device, the first cleaning element and the second cleaning element, that generates a predetermined potential difference between the first cleaning element and the second cleaning element based on the voltage applied to the charging device.

The image forming apparatus according to a second exemplary aspect includes a photosensitive member that holds an image formed by a developing agent, a charging device that charges a surface of the photosensitive member, a voltage applying device that applies a first voltage to the charging device, a first cleaning element provided at the surface of the photosensitive member, a first voltage controlling device, connected to the charging device and the first cleaning element, that applies a second voltage to the first cleaning element based on the first voltage applied to the charging device, and a second voltage controlling device, connected to the charging device and the photosensitive member, that applies a third voltage to the photosensitive member based on the first voltage applied to the charging device such that a potential difference is generated between the photosensitive member and the first cleaning element.

BRIEF DESCRIPTION OF THE DRAWINGS

An embodiment of the invention will de described in detail with reference to the following figures, wherein.

DETAILED DESCRIPTION OF PREFERRED EMBODIMENTS

Figure 1:
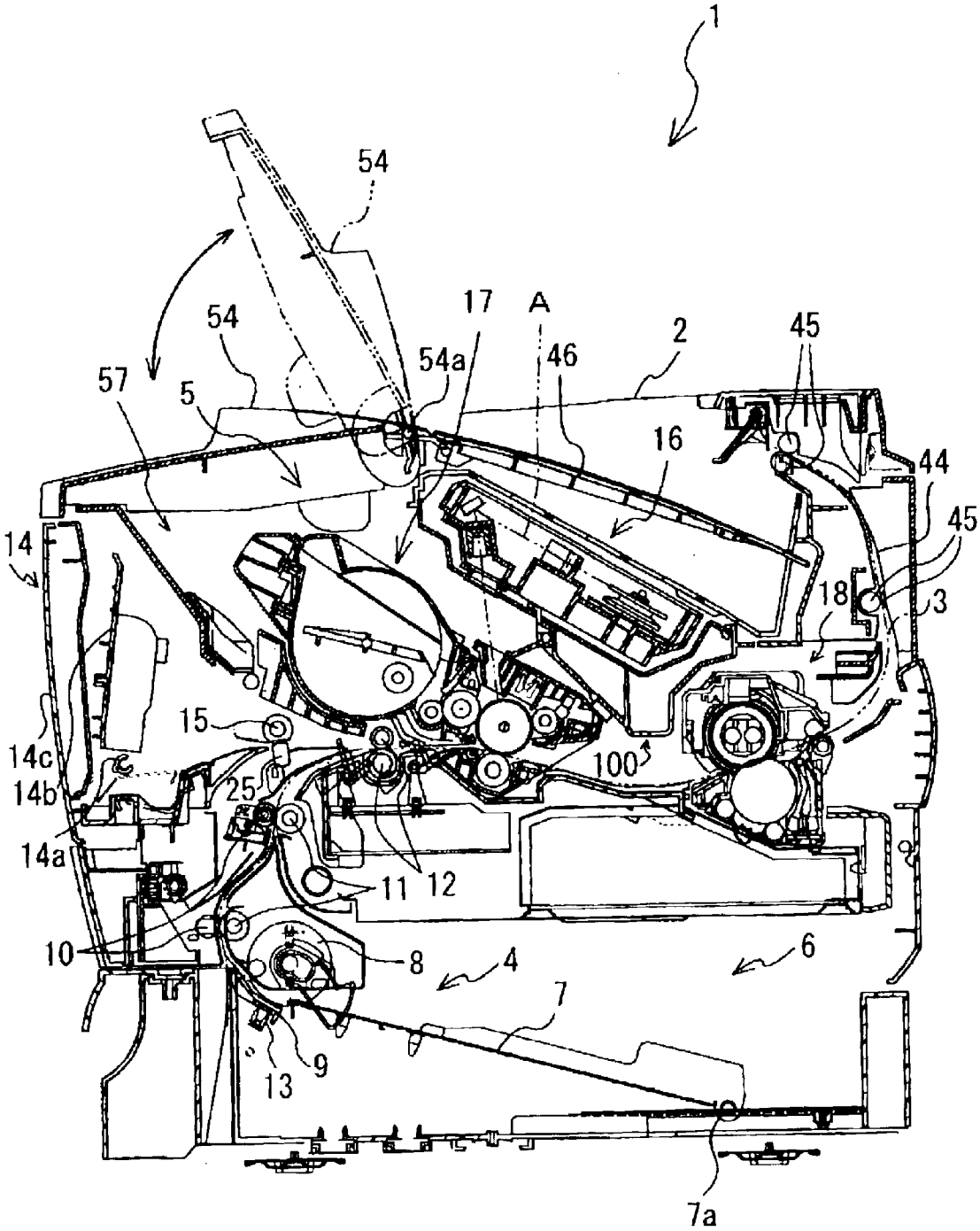
FIG. 1 is a cross-sectional view of a laser printer.

One embodiment of an image forming apparatus of the invention will be explained with reference to the drawings. A structure of a laser printer 1 will be explained with reference to FIG. 1. FIG. 1 is a cross-sectional view of the laser printer 1 of this embodiment. As shown in FIG. 1, the laser printer 1 has a feeder mechanism 4 for feeding a paper 3 that serves as a recording medium and an image forming mechanism 5 for forming a predetermined image on the paper 3 that is fed. The left side in FIG. 1 is a front side of the laser printer 1.

A paper discharge tray 46 is formed in a recess at an upper rear side of a body case 2 so as to store printed papers 3 in a piled condition. A cartridge accommodation 57 is formed at an upper front side of the body case 2. The cartridge accommodation 57 is open upwardly and has a space therein for receiving a process cartridge 17. The cartridge accommodation 57 is covered with a cover 54. The cover 54 is rotated up and down around a support shaft 54*a* arranged at the front edge side of the paper discharge tray 46. An open position of the cover 54 is shown by a dot and dash line in FIG. 1.

A discharge path 44 is arranged at the rear side (the right side in FIG. 1) of the body case 2 so as to form an arc in an up and down direction along a rear surface of the body case 2. A paper is discharged from a fixing device 18 of the image forming mechanism 5 that is arranged at a lower rear side of the body case 2, and the discharged paper is guided along the discharge path 44 toward the paper discharge tray 46 that is arranged at an upper rear side of the body case 2. A discharge roller 45 for transporting the paper 3 is arranged on the discharge path 44.

In the laser printer 1, a paper is discharged in a face-down method. In the face-down method, the paper 3, having an image on its upper surface, is guided by the arc-shaped discharge path 44 and discharged onto the discharge tray 46. When a plurality of papers are printed, the papers 3 are piled on each other with their printing surfaces facing downward in a discharged order. Therefore, the printed papers 3 are piled in a printed order.

The feeder mechanism 4 comprises a paper feeding roller 8, a paper feeding tray 6, a paper pressing plate 7, a separation pad 9, a paper powder removing roller 10 and a resist roller 12. The paper feeding roller 8 is arranged at a bottom of the body case 2. The paper feeding tray 6 is detachably arranged in the body case 2. The paper pressing plate 7 is arranged in the paper feeding tray 6 and stores piled papers 3 and presses the papers 3 to the paper feeding roller 8. The separation pad 9 is arranged on upper side of one end of the paper feeding tray 6 and is pressed toward the paper feeding roller 8. The separation pad 9 holds the paper 3 with the paper feeding roller 8 for transporting the paper 3 and for preventing the paper 3 from being fed upon another fed paper. The paper powder removing rollers 10 are arranged at two positions in the lower stream side of the paper 3 transporting direction with respect to the paper feeding roller 8. The paper powder removing rollers 10 removes paper powder by contacting the paper transporting roller 11. The paper powder removing rollers 10 and the paper transporting roller 11 are also used to transport the paper 3. The resist roller 12 is arranged in the lower stream side of the paper 3 transporting direction with respect to the paper transporting roller 11. The resist roller 12 adjusts the timing for feeding the paper 3 at the printing operation.

The paper pressing plate 7 stores papers 3 in a piled condition. A support shaft 7*a* of the paper pressing plate 7 is arranged at an upstream side of the paper feeding roller 8 and is supported by the bottom surface of the paper feeding tray 6. A downstream side of the paper pressing plate 7 is movable up and down around the support shaft 7*a*. The paper pressing plate 7 is urged toward the paper feeding roller 8 by a spring (not shown) from its rear side. Therefore, the paper pressing plate 7 is moved downwardly around the support shaft 7*a* against an urging force of the spring as the piled amount of the papers 3 are increased. The paper feeding roller 8 and the separation pad 9 are arranged facing each other. The separation pad 9 is pressed toward the paper feeding roller 8 by a spring 13 arranged at a rear side of the separation pad 9.

The feeder mechanism 4 comprises a manual tray 14, a manual roller 15 and a separation pad 25. The manual tray 14 includes a tray 14*b* and a cover 14*c*. The tray 14*b* is arranged at a front side (left side in FIG. 1) of the body case 2 and open and closed in a front and rear direction (left and right direction in FIG. 1) around a support shaft 14*a*. The tray 14*b* stores papers 3 in a piled condition when opened. The cover 14*c* slides with respect to the tray 14*b* and becomes a part of the body case 2 when the tray 14*b* is closed. The manual roller 15 feeds the papers 3 piled on the tray 14*b* of the manual tray 14. The separation pad 25 prevents papers 3 from being fed upon each other.

The manual roller 15 and the separation pad 25 are arranged facing each other and the separation pad 25 is pressed toward the manual roller 15 by a spring (not shown) arranged at a rear side of the separation pad 25. In the printing operation, the paper 3 piled on the manual tray 14 is fed by a frictional force of the rotating manual roller 15 and the separation pad 25 prevents the paper 3 from being fed upon another paper 3 so that the paper 3 is individually transported to the resist roller 12.

Figure 2:
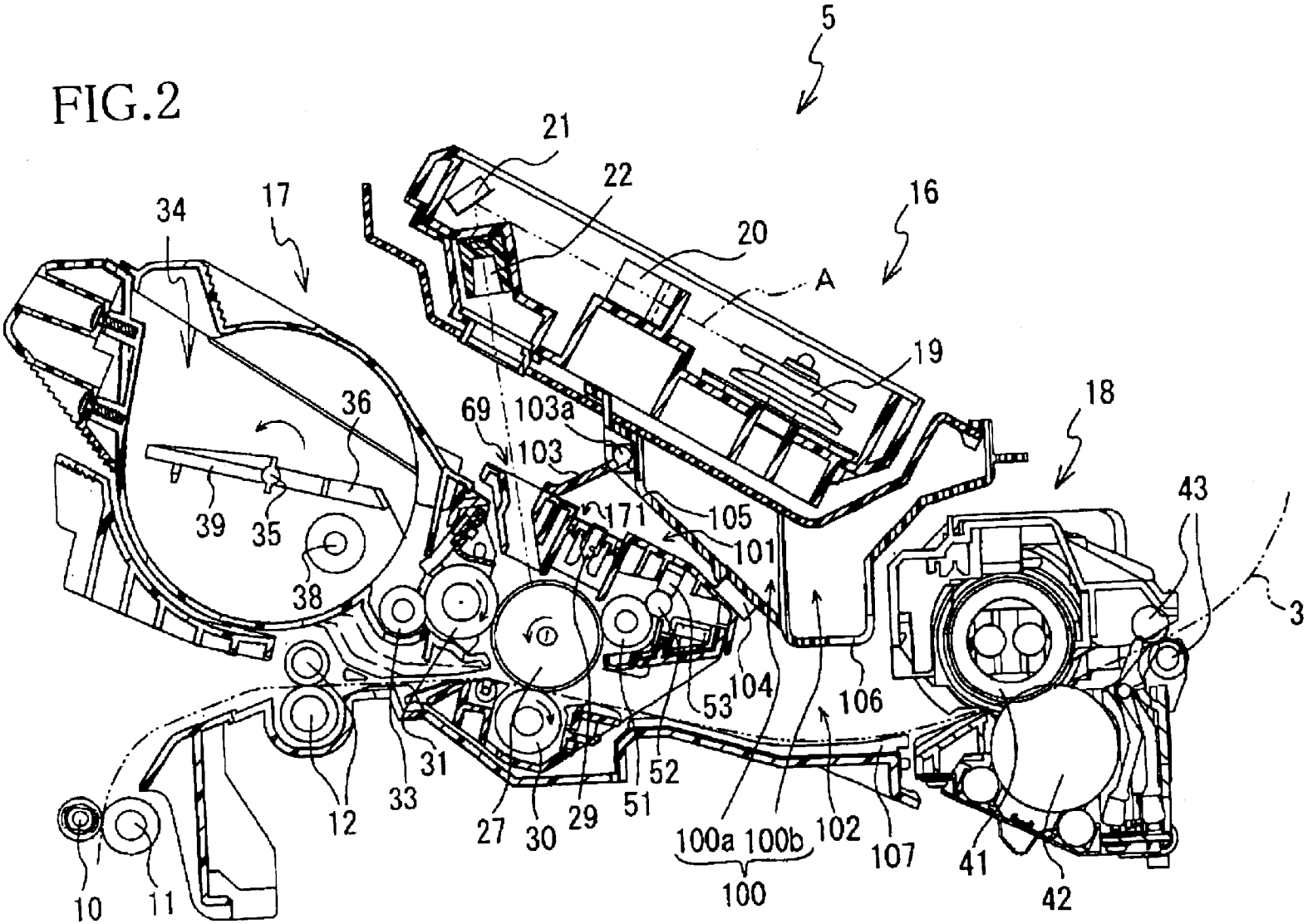
FIG. 2 is a cross-sectional view of an image forming mechanism of the laser printer.

A structure of the image forming mechanism 5 will be explained with reference to FIG. 2. FIG. 2 is a cross-sectional view of the image forming mechanism 5 seen from its side. As shown in FIG. 2, the image forming mechanism 5 comprises a scanner unit 16, a process cartridge 17, a fixing device 18 and a duct 100 so as to form an image on the paper that is transported by the feeder mechanism 4.

The scanner unit 16 is arranged at a lower side of the paper discharge tray 46 in the body case 2. The scanner unit 16 comprises a laser emission portion (not shown), a polygon mirror 19, a fθlens 20, a reflection mirror 21 and a relay lens 22. The laser emission portion emits a laser beam. The polygon mirror 19 is rotated to scan the laser beam that is emitted from the laser emission portion in a main scanning direction. The fθlens 20 keeps the scanning speed constant. The reflection mirror 21 reflects the scanned laser beam. The relay lens 22 adjusts a focus position so as to form an image on the photosensitive drum 27 by the laser beam reflected by the reflection mirror 21.

The laser beam, emitted from the laser emission portion, is based on predetermined image data that is passed through or reflected by in an order of the polygon mirror 19, the fθlens 20, the reflection mirror 21 and the relay lens 22 by the scanner unit 16, as shown by a dash and dot line A. Accordingly, the scanner unit 16 exposes and scans the surface of the photosensitive drum 27 of the process cartridge 17.

The process cartridge 17 comprises the photosensitive drum 27, a scorotron type charger 29, a developing roller 31, a supply roller 33, a toner box 34, a transfer roller 30, a cleaning roller 51, a secondary roller 52 and other components.

The photosensitive drum 27 is arranged aligned with the developing roller 31 so that the rotating shaft of the photosensitive drum 27 is parallel to the rotating shaft of the developing roller 31. The photosensitive drum 27 is in contact with the developing roller 31 and rotated in a direction of an arrow (counterclockwise direction in FIG. 2). A charge generation layer and a charge transporting layer are laminated on a conductive substrate to form the photosensitive drum 27. An organic beam electric conductive body such as an azo pigment or a phthalocyanine pigment is dispersed in a binder resin as a charge generation material to form the charge generation layer. A compound such as a hydrazone type or an aryl amine type is mixed in a resin such as polycarbonate to form the charge transporting layer.

When the photosensitive drum 27 is radiated by the laser beam, charge is generated in the charge generation layer by light absorption and the charge is transported to the surface of the photosensitive drum 27 by the charge transporting layer. The surface of the photosensitive drum 27 is charged with a predetermined surface potential by the scorotron type charger 29. The charge transported by the charge transporting layer nullifies the surface potential and a potential difference is generated between a potential of a radiated portion and a potential of a non-radiated portion. The potential difference forms an electrostatic latent image. In other words, the laser beam is exposed and scanned based on image data and the electrostatic latent image corresponding to the image data is formed on the photosensitive drum 27. The photosensitive drum 27 serves as a photosensitive member of the invention.

The scorotron type charger 29, serving as a charging device, is arranged above the photosensitive drum 27 and apart from the photosensitive drum 27 by a predetermined space therebetween so as not to contact the photosensitive drum 27. The scorotron type charger 29 is a scorotron type charger for positive charging. In the positive charging, corona discharge is generated from a discharge wire made of tungsten. The scorotron type charger 29 positively and uniformly charges the surface of the photosensitive drum 27.

The scorotron type charger 29 is controlled on/off by a high voltage generation circuit 200. An opening 171 is formed so as to discharge ozone or other components that is generated in a charging outside of the process cartridge 17. The opening 171 is formed on an upper surface of a casing of the process cartridge 17 adjacent to the scorotron type charger 29 and in communication with outside air. The scorotron type charger 29 serves as a charging device of the invention.

The developing roller 31 is arranged at the lower stream side from the scorotron type charger 29 with respect to the rotation direction (counterclockwise direction in FIG. 2) of the photosensitive drum 27. The developing roller 31 is rotatable in a clockwise direction shown by an arrow. The developing roller 31 is formed by covering a metal roller shaft with a conductive rubber material and a developing bias is applied to the developing roller 31 from the high voltage generation circuit 200.

The supply roller 33 is aligned with the developing roller 31 and is arranged rotatably at a position opposite to the photosensitive drum 27. The supply roller 33 is in contact with the developing roller 31 in a compressed condition. The supply roller 33 is formed by covering a metal roller shaft with a conductive foaming material to charge toner that is supplied to the developing roller 31 by frictional force.

The toner box 34 is arranged near the supply roller 33 and stores therein toner that is supplied to the developing roller 31 via the supply roller 33. In this embodiment, the positive charged non-magnetic one component polymerized toner is used as a developer. The toner is a polymerized toner that is obtained by copolymerizing polymerization monomer such as styrene monomer or acrylic monomer such as acryl acid, alkyl (C1–C4) acrylate, and alkyl (C1–C4) methaacrylate by a known polymerization method such as suspension polymerization. Coloring agent such as carbon black or wax is mixed with the polymerization toner and an additive such as silica is added to the polymerization toner for improving fluidity. A particle diameter of the polymerization toner is approximately 6–10 $\mu$m.

Toner in the toner box 34 is agitated when an agitator 36 is rotated in a direction of an arrow (counterclockwise direction in FIG. 2). The agitator 36 is supported by a rotation shaft 35 that is arranged at a center of the toner box 34. A window 38 for checking a remaining amount of toner is arranged on a side wall of the toner box 34 and the window 38 is cleaned by a cleaner 39 that is supported by the rotation shaft 35.

The transfer roller 30 is arranged at a lower stream side from the developing roller 31 and at a lower side of the photosensitive drum 27. The transfer roller 30 is supported rotatably in a direction of an arrow (clockwise direction in FIG. 2). The transfer roller 30 is formed by covering a metal roller shaft with an ion conductive rubber material. Transfer bias (regular transfer bias) is applied from the high voltage generation circuit 200 at a transferring operation.

The cleaning roller 51 is arranged near the photosensitive drum 27. The cleaning roller 51 is positioned at a lower stream side in the rotation direction of the photosensitive drum 27 from the transfer roller 30 and an upper stream side from the scrotron type charger 29. The secondary roller 52 is arranged at an opposite side from the photosensitive drum 27 and holding the cleaning roller 51 therebetween so as to contact the cleaning roller 51. A wiping member 53 is in contact with the secondary roller 52.

The photosensitive drum 27 of the laser printer 1 is cleaned by a cleanerless method described below. After toner is transferred from the photosensitive drum 27 to a paper 3 by the transfer roller 30, the toner or the paper powder remaining on the surface of the photosensitive drum 27 is electrically attracted to the cleaning roller 51.

Only the paper powder is electrically attracted from the cleaning roller 51 to the secondary roller 52. The paper powder attracted by the secondary roller 52 is wiped by the wiping member 53. The cleaning roller 51 serves as the first cleaning element of the invention and the secondary roller 52 serves as the second cleaning element of the invention.

An exposure window 69 is arranged above the photosensitive drum 27 so that the laser beam from the scanner unit 16 is directly radiated to the photosensitive drum 27. The exposure window 69 is open so that the photosensitive drum 27 is communicated with outside of the process cartridge 17. The exposure window 69 is provided on an upper surface of the case of the process cartridge 17 and at a toner box 34 side from the opening 171 of the scorotron type charger 29.

The fixing device 18 is arranged at a lower stream side of the process cartridge 17. The fixing device 18 comprises a heating roller 41, a pressure roller 42 for pressing the heat roller 41, and a pair of transporting rollers 43 arranged at a lower side of the heating roller 41 and the pressure roller 42. The heating roller 41 is made of metal and has a halogen lump for heating in a cylindrical roller. Toner, that is transferred to a paper 3 at the process cartridge 17, is pressed and heated when the paper 3 passes through the heating roller 41 and the pressure roller 42 and fixed onto the paper 3. Afterwards, the paper 3 is transported to the paper discharge path 44 by the transporting roller 43.

The duct 100 discharges atmosphere to the outside of the body case by a fan (not shown). The duct 100 is a discharge path of a cylindrical shape corresponding to a length of a width (a direction perpendicular to the insertion direction of the process cartridge 17) of the process cartridge 17 and has a V-shape as shown from the side. The duct 100 is divided into two chambers by a wall so that the two chambers are aligned with each other in the width direction of the process cartridge 17. The duct 100 comprises a duct 100*a* for discharging generated gas such as ozone that is generated by the scorotron type charger 29 and a duct 100*b* for discharging heated atmosphere that is generated from the fixing device 18.

When the process cartridge 17 is mounted to the body case 2, a discharge chamber 101 is formed so as to cover the vicinity of the opening 171, that is provided on the upper surface of the case of the process cartridge 17 and in the vicinity of the scrorotron type charger 29, with a shutter 103, a lower surface of the duct 100*a*, a division member 104 and two side plates of the cartridge accommodation (not shown). Ozone, that is generated from the scorotron type charger 29, is filled in the discharge chamber 101 and an opening 105 is formed on a lower surface of the duct 100*a* corresponding to the scorotron type charger 29 so that the ozone atmosphere is discharged from the duct 100*a*.

The division member 104 is provided at a portion of the lower surface of the duct 100*a* where the distal end of the process cartridge 17 in the insertion direction contacts at the mounting of the process cartridge 17. The division member 104 extends in the width direction of the process cartridge 17 (the direction perpendicular to the insertion direction) by the length of the duct 100. The division member 104 serves as a shock absorber at the insertion of the process cartridge 17.

The shutter 103 is an elongated plate shaped member that is elongated in the width direction of the process cartridge 17. A support shaft 103*a* that is provided at one edge of the shutter 103 is supported by a lower surface of the duct 101*a*. The support shaft 103*a* is provided at a lower stream side of the insertion direction of the process cartridge 17 and is supported so that a free end side of the shutter 103 is movable in an up-down direction.

An opening portion 106 is formed at a lower surface of the duct 100*b*. A discharge chamber 102 is formed by a distal end wall of the mounted process cartridge 17 in the insertion direction, a lower surface of the duct 100*b*, the fixing device 18 and a discharging plate 107. Atmosphere in the discharge chamber 102 is discharged from the duct 100*b* via the opening portion 106.

The discharging plate 107 is arranged on the paper 3 transporting path between the process cartridge 17 and the fixing device 18. The discharging plate 107 discharges the paper 3 that is charged by passing through the process cartridge 17 during the printing operation. The discharging plate 107 is formed so that a plurality of grooves are aligned with each other in the paper 3 transporting direction. The discharging plate 107 also serves as a paper guide.

Figure 3:
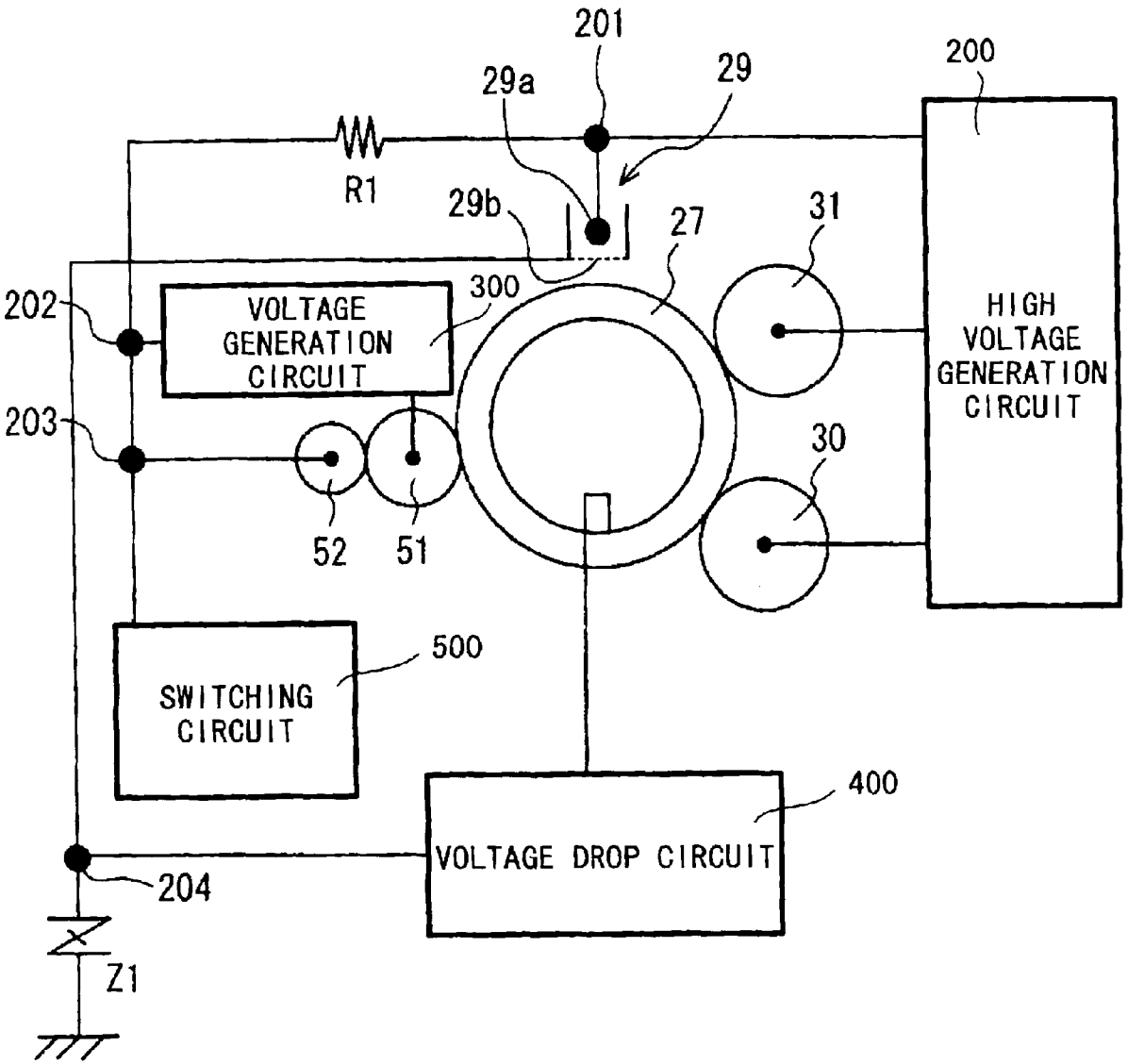
FIG. 3 is a block diagram showing an electric structure in a vicinity of a cleaning mechanism.
Figure 4:
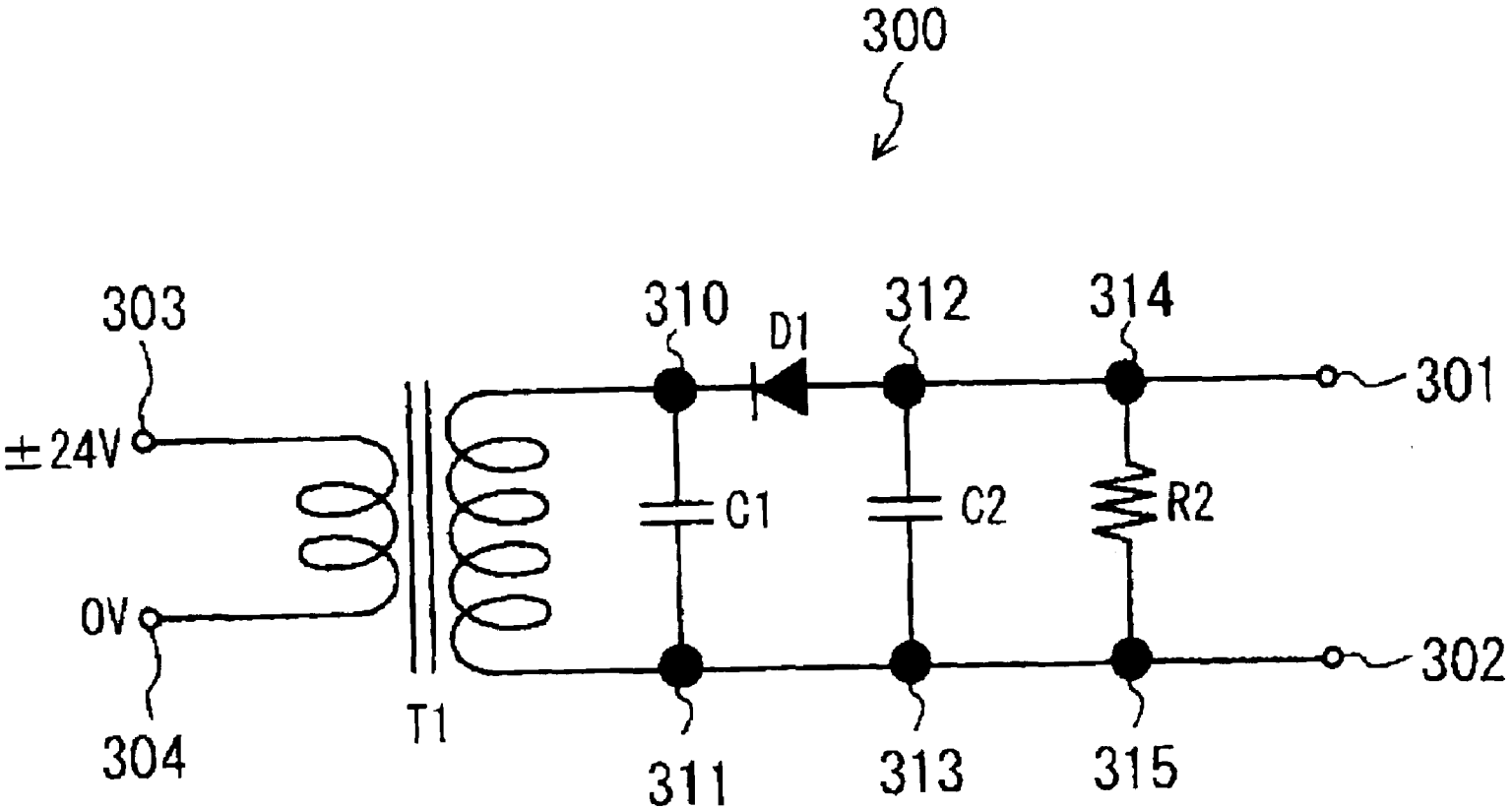
FIG. 4 is a circuit diagram of a voltage generation circuit.
Figure 5:
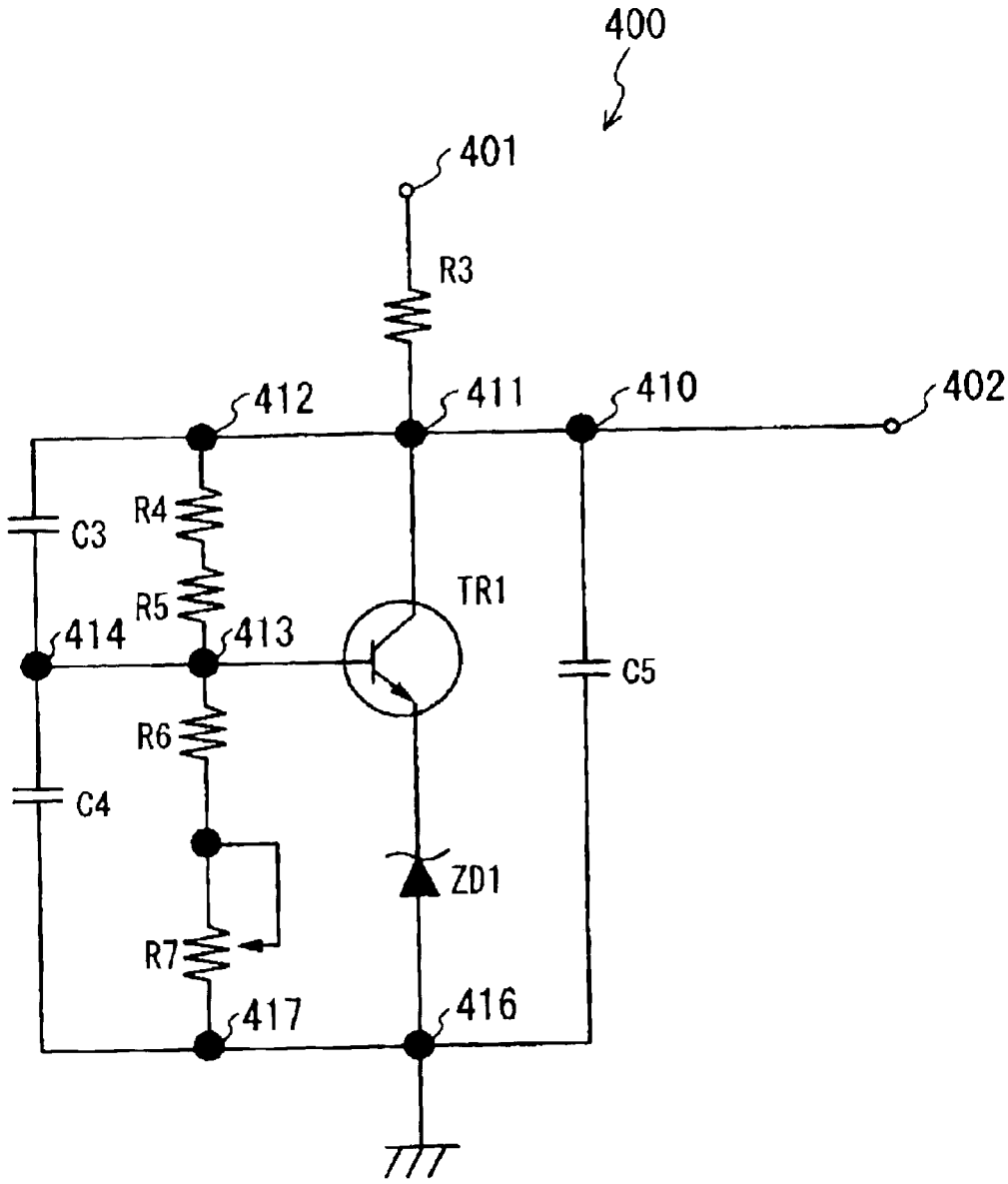
FIG. 5 is a circuit diagram of a voltage drop circuit.
Figure 6:
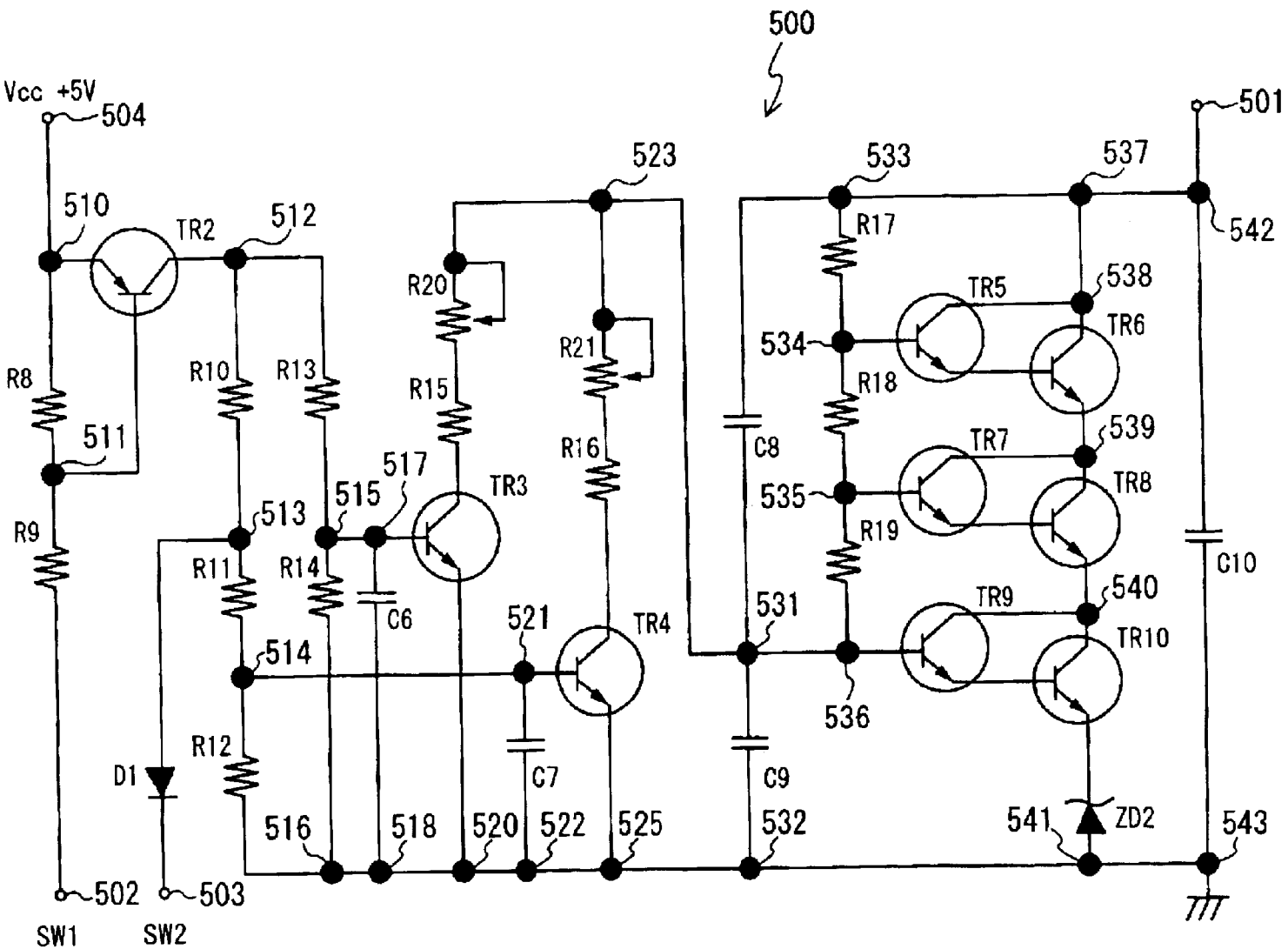
FIG. 6 is a circuit diagram of a switching circuit.

An electrical structure in the vicinity of the cleaning mechanism of this embodiment will be explained with reference to FIGS. 3–6. FIG. 3 is a block diagram showing the electrical structure in the vicinity of the cleaning mechanism. FIG. 4 is a circuit diagram of the high voltage generation circuit 300. FIG. 5 is a circuit diagram of the voltage drop circuit 400. FIG. 6 is a circuit diagram of the switching circuit 500.

As described above, the scorotron type charger 29, the developing roller 31, the transfer roller 30 and the cleaning roller 51 are arranged around the photosensitive drum 27 of the process cartridge 17, in order, along the rotational direction of the photosensitive drum 27.

As shown in FIG. 3, the high voltage generation circuit 200 of the laser printer 1 is connected to a charge electrode 29*a*, the developing roller 31 and the transfer roller 30 and applies high voltage as a charge bias, a developing bias and a transfer bias. The charge bias of approximately 700V is applied to the charge electrode 29*a* from the high voltage generation circuit 200 for corona discharge.

A line for connecting the charge electrode 29*a* and the high voltage generation circuit 200 is branched at a connection 201 and connected to the voltage generation circuit 300 that is branched form a connection 202, the secondary roller 52 that is branched from a connection 203 and the switching circuit 500 via a resistor R1. The cleaning roller 51 is connected to the voltage generation circuit 300. A grid electrode 29*b* of the scorotron type charger 29 is earthed via a varistor Z1 and branched from a connection 204 to be connected to the voltage drop circuit 400. The photosensitive drum 27 is connected to the voltage drop circuit 400.

The high voltage generation circuit 200 serves as a voltage applying device of the invention, the voltage generation circuit 300 serves as a first voltage controlling device of the invention, the voltage drop circuit 400 serves as a second voltage controlling device of the invention and the switching circuit 500 serves as a third voltage controlling device.

As shown in FIGS. 3 and 4, a contact 301 of the voltage generation circuit 300 is connected to the cleaning roller 51 and a contact 302 is connected to the connection 202. The voltage generation circuit 300 is connected to the charge electrode 29*a* of the scorotron type charger 29 via the secondary roller 52, the switching circuit 500 and the resistor R1. When a potential of the contact 302 is varied according to the switching operation of the switching circuit 500, a potential difference between the contacts 301, 302 is also varied.

The voltage generation circuit 300 is a known circuit that comprises a transformer T1, a resistor R2, capacitors C1, C2 and a diode D1. A contact 303 on the side of a main coil of the transformer T1 is connected to an electric source circuit (not shown) and alternating voltage of ±24V is supplied thereto. A contact 304 is earthed and the potential of the contact 304 is always 0V. The number of turns of a coil of the transformer T1 is adjusted to have a potential of approximately ±100V on the side of a secondary coil.

The capacitor C1, the capacitor C2 and the resistance R2 are connected between an electrode of the contact 301 side and an electrode of the contact 302 side on the secondary coil side of the transformer T1. The capacitor C1 is connected between the connections 310 and 311, the capacitor C2 is connected between the connections 312 and 313, and the resistance R2 is connected between the connections 314 and 315. The diode D1 is arranged between the connections 310 and 312 and an anode of the diode D1 is connected to the connection 312 and a cathode of the diode D1 is connected to the connection 310 so that an electric current flows only in a direction from the contact 301 to the transformer T1.

As shown in FIGS. 3 and 5, a contact 401 of the voltage drop circuit 400 is connected to a connection 204 and has same potential as the grid electrode 29*b* of the scorotron type charger 29. A contact 402 is connected to the photosensitive drum 27. Potential of the connection 204, or potential (grid potential) of the grid electrode 29*b* is maintained at 1000V by using the varistor Z1. In the voltage drop circuit 400, the grid potential of approximately 1000V is dropped to a potential of approximately 100V on the output terminal side to the photosensitive drum 27.

The voltage drop circuit 400 is a known circuit that comprises a transistor TR1 of an NPN type, resistors R3–R6, a variable resistor R7, capacitors C3–C5 and a Zener diode ZD1. The contact 301 is connected to the connection 411 via the resistor R3. The connection 411 is connected to the contact 402, a collector of the transistor TR1 and the capacitor C3. The capacitor C5 is connected to the connection 410 that is between the connection 411 and the contact 402 and the other end of the capacitor C5 is earthed via the connection 416. An emitter of the transistor TR1 is connected to a cathode of the Zener diode ZD1 and an anode of the Zener diode ZD1 is earthed via the connection 416.

The capacitor C3 is serially connected with the capacitor C4 and the other end of the capacitor C4 is earthed via the connection 416. The resistors R4, R5, R6 and the variable resistor R6 are serially connected in the order from the connection 412 that is between the connection 411 and the capacitor C3. The variable resistor R7 is connected to the connection 417 that is between the capacitor C4 and the connection 416 and earthed via the connection 416. The connection 414 that is between the capacitors C3 and C4, the connection 413 that is between the resistors R5 and R6 and a base of the transistor TR1 are connected to each other.

As shown in FIGS. 3 and 6, a contact 501 of the switching circuit 500 is connected to the connection 203 and has same potential as the secondary roller 52. The charge electrode 29*a* of the scorotron type charger 29 applies voltage to the contact 501 via the resistor R1 that has a resistance value of 50MΩ and the potential of the contact 501 is switched by a switching operation. Contacts 502, 503 are connected to a control circuit (not shown) and the control circuit controls signals that are input to the contacts 502, 503 to carry out the switching operation. A contact 504 is connected to an electric source circuit (not shown) and constant voltage of +5V is supplied thereto.

The switching circuit 500 comprises a transistor TR2 of a PNP type, transistors TR3–TR10 of a NPN type, transistors R8–R19, variable transistors R20, R21, capacitors C6–C10, a diode D1 and a Zener diode ZD2. The switching circuit 500 is a known circuit that uses a transistor switch. Resistance values of the resistors R8–R19 and the variable resistors R20, R21 are 2.2KΩ, 10 KΩ, 180KΩ, 390KΩ, 2.2MΩ, 560KΩ, 2.2MΩ, 6.8MΩ, 680KΩ, 30MΩ, 30MΩ, 30MΩ, 1MΩ, 300KΩ respectively. Capacitites of the capacitors C6–C9 are 0.001 μF, 0.001 μF, 220 pF, 0.01 μF respectively.

The contact 501 is connected to the connection 542, and the capacitors C8, C10 are connected from the connection 542 respectively and the other end of the capacitor C10 is earthed. The capacitor C8 is connected to the capacitor C9 and the other end of the capacitor C9 is connected to the connection 543 that is between the capacitor C10 and the earthed electrode and earthed. Connections 537, 533 are arranged between the connection 542 and the capacitor C8. The resistors R1, R18, R19 are serially connected to the connection 533. A base of the transistor TR5 is connected to the connection 534 that is between the resistors R17 and R18 and a base of the transistor TR7 is connected to the connection 535 that is between the resistors R18, R19.

The other end of the resistor R19 is connected to a connection 536 that is arranged on a connection line connecting the connection 531 that is between the capacitors C8 and C9 and the base of the transistor TR9. Each emitter of the transistors TR5, TR7, TR9 is connected to each base of the transistors TR6, TR8, TR10. Each collector of the transistors TR5, TR7, TR9 is connected to a connection 538, 539, 540 respectively. The connection 538 is on the connection line connecting the collector of the transistor TR6 and the connection 537, and the connection 539 is on the connection line connecting the emitter of the transistor TR6 and the collector of the transistor TR8, and the connection 540 is on the connection line connecting the emitter of the transistor TR8 and the collector of the transistor TR10.

The emitter of the transistor TR10 is connected to the cathode of the Zener diode ZD2. The anode of the Zener diode ZD2 is connected to the connection 541 that is on the connection line connecting the capacitor C9 and the connection 543 and is earthed. The transistor TR5, TR7, TR9 is connected to the transistor TR6, TR8, TR10 by Darlington connection respectively. The transistors TR5, TR6, TR7, TR8, TR9, TR10 are main components of the known constant voltage circuit.

The resistors R8, R9 are serially connected between the contact 504 and the contact 502. The connection 510 that is between the contact 504 and the resistor R8 and the connection 511 that is between the resistors R8 and R9 are connected to the emitter and the base of the transistor TR2 respectively. The resistors R10, R11, R12 are serially connected to the collector of the transistor TR2 and the other end of the resistor R12 is connected to the connection 532 and earthed. The connections 516, 518, 520, 522, 525 are arranged between the resistor R12 and the connection 532. The connection 513 that is between the resistors R10 and R11 is connected to the anode of the diode D1 and the cathode of the diode D1 is connected to the contact 503.

The resistors R13, R14 are serially connected to the connection 512 that is between the collector of the transistor TR2 and the resistor R10 and the connection 512 is connected to the connection 516. The connection 515 that is between the resistors R13 and R14 is connected to the base of the transistor TR3. The capacitor C6 is connected between the connection 517 and 518. The connection 517 is on the connection line connecting the connection 515 and the transistor TR3.

The emitter of the transistor TR3 is connected to the connection 520 and the collector of the transistor TR3 is connected to the connection 531 via the resistor R16 and the variable resistor R15 that are serially connected. The connection 523 is arranged between the variable resistor R15 and the connection 531. The connection 514 that is between the resistors R11 and R12 is connected to the base of the transistor TR4 and the capacitor C7 is connected between the connection 521 and 522. The connection 521 is on the connection line connecting the connection 514 and the transistor TR4. The emitter of the transistor TR4 is connected to the connection 525 and the collector of the transistor TR4 is connected to the connection 523 via the resistor R18 and the variable resistor R17 that are serially connected.

The printing operation of the laser printer 1 will be explained with reference to FIGS. 1 and 2. A paper 3 that is placed at the top of the piled papers on the paper pressing plate 7 of the paper supply tray 6 is pressed toward the paper feeding roller 8 by a spring (not shown) from the rear side of the paper pressing plate 7. When the printing operation is started, the paper 3 is fed by the frictional force between the paper 3 and the rotating paper feeding roller 8 and held between the paper feeding roller 8 and the separation pad 9.

A plurality of papers 3 may be fed at the same time based on the influence of the frictional force between the paper 3 and the paper feeding roller 8. The separation pad 9 prevents a plurality of papers from being transported at the same time. The distal end of the papers 3 in the transporting direction receives resistance by the frictional force between the papers 3 and the separation pad 9 and the papers 3 are separated one by one. When the separated paper 3 passes the paper powder removing roller 10, the paper powder that is adhered on the surface of the paper 3 is removed, and the paper 3 is transported to the resist roller 12 by a pair of transporting rollers 11.

In the scanner unit 16, the laser beam, that is generated at the laser emission portion based on the laser drive signal that is generated by an engine controller (not shown), is radiated to the polygon mirror 19. The polygon mirror 19 scans the radiated laser beam in the main scanning direction (a direction perpendicular to the paper 3 transporting direction) and radiates the laser beam to the fθlens 20. The fθlens 20 converts the laser beam that is scanned to be equal to the angular speed and scanning speed. The radiation direction of the laser beam is changed by the reflection mirror 21 and the laser beam is converged by the relay lens 22 and an image is formed on the surface of the photosensitive drum 27.

The surface potential of the photosensitive drum 27 is charged to approximately 1000V by the scorotron type charger 29. Next, the photosensitive drum 27 that is rotated in the counterclockwise direction shown by the arrow receives radiation of the laser beam. The laser beam is radiated on the main scanning line of the paper 3 so that the portion of the photosensitive drum 27, where toner is adhered, is radiated and the portion where toner is not adhered is not radiated. The surface potential of the portion of the photosensitive drum 27 where the laser beam is radiated (light portion) is dropped to approximately 100V.

The laser beam is radiated in the secondary scanning direction or the paper 3 transporting direction according to the rotation of the photosensitive drum 27. An electrical invisible image, or an electrostatic latent image is formed on the surface of the photosensitive drum 27 by the portions where the laser beam is not radiated (dark portion) and the light portion.

Toner in the toner box 34 is supplied to the developer roller 31 by the rotation of the supply roller 33. The toner is positively charged by the frictional force between the supply roller 33 and the developing roller 31 and adjusted to have a predetermined thickness and the toner is borne by the developing roller 31. The positive voltage of approximately 550V is applied to the developing roller 31 as a developing bias. The toner that is borne by the developing roller 31 and positively charged is transferred onto the electrostatic latent image that is formed on the surface of the photosensitive drum 27 when contacting the photosensitive drum 27 in accordance with the rotation of the developing roller 31. The potential of the developing roller 31 (+550V) is lower than the potential of the dark portion (+1000V) and higher than the potential of the light portion (+100V). Therefore, the toner is selectively transferred to the light portion that has a lower potential. Accordingly, the visible image is formed on the surface of the photosensitive drum 27 by the toner.

The resist roller 12 temporally stops the paper 3 to correct the slant of the paper 3 and feeds the paper 3 at the time when the start of the end of the visible image, that is formed on the surface of the rotating photosensitive drum 27, is consistent with the top end of the paper 3. When the paper 3 passes between the photosensitive drum 27 and the transfer roller 30, the transfer bias of approximately −8000V that is lower than the potential of the light portion (+100V) is applied to the transfer roller 30.

The toner that is adhered to the surface of the photosensitive drum 27 will move to the transfer roller 30. However, the toner is obstructed by the paper 3 and does not reach the transfer roller 30. As a result, the toner is transferred onto the paper 3. Thus, the visible image formed on the surface of the photosensitive drum 27 is transferred onto the paper 3.

The paper 3 where the toner is transferred is transported to the fixing device 18. On the way to the fixing device 18, the paper 3 passes by the discharging plate 107 that is earthed. The remaining charge on the toner or the paper 3 is removed by the discharging plate 107. The fixing device 18 applies heat of approximately 200° C., that is generated by the heat roller 41, and pressure by the pressure roller 42 to the paper 3 bearing the toner is used in order to melt and fix the toner onto the paper 3 and form a permanent image.

The heat roller 41 and the pressure roller 42 are earthed via the diode and the surface potential of the pressure roller 42 is lower than the surface potential of the heat roller 41. The positively charged toner that is adhered to the heat roller 41 side of the paper 3 and is electrically attracted to the pressure roller 42 side via the paper 3. Therefore, deterioration of images that is caused by attraction of the toner to the heat roller 41 when fixing is prevented.

The paper 3 where the toner is pressed and heated to be fixed is transported along the paper discharge path 44 by the discharge roller 45 and discharged to the paper discharge tray 46 with its printed surface facing down. A paper 3 that is to be printed next is also piled on the discharged paper 3 in the discharge tray 46 with its printed surfaces facing down. Thus, the user can obtain papers 3 that are ordered in the printed order.

The operation of the voltage generation circuit 300, the voltage drop circuit 400 and the switching circuit 500 will be explained with reference to FIGS. 4–6. As shown in FIG. 4, in the voltage generation circuit 300, the alternating voltage of ±24V, that is supplied from the electric source circuit (not shown), is amplified by the transformer T1 and applied between the contacts 301 and 302. At this time, the alternating voltage is half-wave rectified by the diode D1 and smoothed by the capacitors C1, C2 and the resistor R2. Then, the potential difference of −100V is generated between the contacts 301 and 302. Therefore, the potential difference between the cleaning roller 51 and the secondary roller 52 is −100V. The transformer T1 and the circuit for half-wave rectification, including the diode D1, comprise voltage drop means of the invention.

As shown in FIG. 5, in the voltage drop circuit 400, the voltage that is applied to the photosensitive drum 27 is voltage obtained by adding break down voltage of the Zener diode ZD1 to the voltage V411–416 between the connections 411 and 416, or the voltage between the collector and the emitter of the transistor TR1. V411–416 is increased in proportional to the grid potential and when the voltage applied between the connections 413 and 416 becomes higher than the sum of the break down voltage of the Zener diode ZD1 and the drop voltage between the base and the emitter of the transistor TR1, a current starts to be supplied to the Zener diode ZD1 via between the base and the emitter of the transistor TR1. The potential of the emitter of the transistor TR1 is maintained by the Zener diode ZD1.

The current supplied to the base of the transistor TR1 is as follows:

$$V_{411\text{-}413}/(R4+R5)-V_{413\text{-}417}/(R6+R7)$$

Since the voltage $V_{413\text{-}417}$ between the connections 413 and 417 is almost constant, it is proportional to $V_{411\text{-}416}$. Therefore, if $V_{411\text{-}416}$ is increased, the current that flows between the base and the emitter of the transistor TR1 is increased. Then, the current that flows between the collector and the emitter of the transistor TR1 is amplified. As a result, the voltage between the collector and the emitter of the transistor TR1 will be decreased and $V_{411\text{-}416}$ will be dropped. Thus, the voltage applied to the photosensitive drum 27 is maintained constant. The voltage applied to the photosensitive drum 27 is adjusted to be approximately +100V by the variable resistor R7.

As shown in FIGS. 3 and 6, in the switching circuit 500, the potential of the contact 501 is switched based on a signal current that is input to the contact 502, 503 from the control circuit (not shown).

As described above, in the laser printer 1, the scorotron type charger 29 applies the voltage of 1000V to the photosensitive drum 27 to charge it. The laser beam is radiated to expose the photosensitive drum 27 and the toner is transferred to the light portion of the photosensitive drum 27 having the potential of approximately 100V from the developing roller 31 where the developing bias of approximately 550V is applied. The toner is transferred to the paper 3 that passes between the transfer roller 30 where the transfer bias of approximately −800V is applied and the photosensitive drum 27.

The remaining toner that is not transferred onto the paper 3 or the paper powder of the paper 3 remains on the surface of the photosensitive drum 27 after transfer. The toner or the paper powder is mechanically wiped and electrically attracted by the cleaning roller 51 that contacts the photosensitive drum 27. Only the paper powder that is attracted by the cleaning roller 51 is attracted by the secondary roller 52. When the toner is not transferred onto the paper 3, the toner that the cleaning roller 51 bears is returned to the photosensitive drum 27 after the paper powder is removed from the cleaning roller 51.

The switching circuit 500 switches the voltage applied to the secondary roller 52 to switch the potential of the cleaning roller 51 that is maintained at almost 100V with respect to the secondary roller 52. In the switching circuit 500, the voltage applied to the secondary roller 52 is switched between three modes of approximately 0V, 100V and 900V. When the voltage is switched in the three modes, the potential of the cleaning roller 51 becomes approximately −100V, 0V and 800V respectively.

When the control circuit (not shown) applies a signal or a current to the contact 502 of the switching circuit 500, the first switch (SW1) is on. When the control circuit (not shown) does not apply a signal or a current to the contact 502, the SW1 is off. Similarly, when the control circuit (not shown) applies a signal or a current to the contact 503, the second switch (SW2) is on. When the control circuit (not shown) does not apply a signal or a current to the contact 503, the SW2 is off. The voltage applied to the secondary roller 52 is switched by the combination of on/off of the SW1 and the SW2.

When the voltage applied to the secondary roller 52 by the switching circuit 500 is approximately 0V, the SW1 is off. The SW2 may be on or off. When the SW1 is off, the current is not supplied to the base of the transistor TR2. Then, no output is from the emitter of the transistor TR2 and the base current of the transistors TR3, TR4 is stopped. Therefore, there is no emitter output from the transistors TR3, TR4.

On the other hand, the current that is supplied from the charge electrode 29*a* of the scorotron type charger 29 to the contact 501 of the switching circuit 500 via the resistor R1 is supplied to each base of the transistor TR5, TR6, the transistor TR7, TR8 and the transistor TR9, TR10. The transistors TR5, TR7, RT9 and the transistors TR6, TR8 and TR10 are connected by a Darlington connection respectively. Accordingly, the current flows between the collector and the emitter of the transistors TR6, TR8, TR10.

The connection 537 is conducted to the connection 541 by the amplification of the transistors TR6, TR8, TR10. At this time, the voltage applied to the contact 501 is a voltage of approximately 10V that is a sum of the break down voltage (approximately 7V) of the Zener diode ZD2 and the drop voltage between each collector and each emitter of the transistors TR6, TR8, TR10. Compared to the charge electrode 29*a* where the voltage of approximately 7000V is applied, the voltage applied to the contact 501 is substantially 0V. In other words, the potential of the secondary roller 52 is approximately 0V, and the potential of the cleaning roller 51 is −100V.

When the switching circuit 500 applies the voltage of approximately 100V to the secondary roller 52, the SW1 and the SW2 are turned on. When the SW1 is on, a current is supplied to the base of the transistor TR2. Then, a current flows between the collector and the emitter of the TR2 by the amplification of the transistor TR2, and a current flows to the base of the transistor TR3 via the resistor R13. A current flows between the collector and the emitter of the transistor TR3 by the amplification of the transistor TR3 and a current from the charge electrode 29*a* flows to the collector of the transistor TR3 via the resistors R17, R18, R19 and the variable resistor R20 and the resistor R15 and further flows from the emitter to earth via the connections 520, 543.

On the other hand, because the SW2 is on, the current that flows between the collector and the emitter of the transistor TR2 flows to the diode D1 via the resistor R10 and does not flow to the resistor R11 that has larger load than the diode D1. Therefore, the current does not flow to the base of the transistor TR4. As a result, the current that flows to each base of the transistors TR5, TR6, the transistors TR7, TR8 and the transistors TR9, TR10 decreases and the voltage between each collector and each emitter of the transistors TR6, TR8, TR10 increases. That is, the voltage that is generated between the connections 537 and 541 increases. The transistors TR5, TR7, TR9 and the transistors TR6, TR8, TR10 are connected by a Darlington connection respectively.

The resistance value of the variable resistor R20 is adjusted as follows. The base current flows to the transistors TR5, TR6, the transistors TR7, TR8 and the transistors TR9, TR10 so that the voltage generated between the connections 537 and 541 becomes approximately 100V. At this time, the potential of the cleaning roller 51 is approximately 0V. When the switching circuit 500 applies the voltage of approximately 900V to the secondary roller 52, the SW1 is on and the SW2 is off. When the SW1 is on, as described above, a current flows between the collector and the emitter of the transistor TR2, and a current flows to the base of the transistor TR3 via the resistor R13. Since the SW2 is off a current from the transistor TR2 flows to the base of the transistor TR4 via the resistors R10, R11.

A current flows between each collector and each emitter of the transistors TR3, TR4. A current from the charge electrode 29*a* flows to the collector and the emitter of the transistor TR3 via the resistors R17, R18, R19, the variable resistor R20 and the resistor R15 and further flows to earth via the connections 520, 543. Similarly, a current from the charge electrode 29*a* flows to the collector and the emitter of the transistor TR4 via the resistors R17, R18, R19, the variable resistor R21 and the resistor R16 and further flows to earth via the connections 525, 543.

As a result, a current that flows to each base of the transistors TR5, TR6, the transistors TR7, TR8 and the transistors TR8, TR10 is more decreased and the voltage between each collector and each emitter of the transistors TR6, TR8, TR10 is more increased than the case when the SW1 and the SW2 are on. The transistors TR5, TR7, TR9 and the transistors TR6, TR8, TR10 are connected by a Darlington connection respectively.

The resistance value of the variable resistor R21 is adjusted as follows. The base current flows to the transistors TR6, TR7, the transistors TR8, TR9 and the transistors TR9, TR10 so that the voltage generated between the connections 537 and 541 becomes approximately 900V. At this time, the potential of the cleaning roller 51 is approximately 800V.

Table 1 shows the conditions of the SW1 and the SW2, the potential of the secondary roller 52 and the potential of the cleaning roller 51.

TABLE 1

| SW1 | SW2 | 2nd roller potential | cleaning roller potential |
|---|---|---|---|
| OFF | OFF or ON | 0 V | −100 V |
| ON | ON | 100 V | 0 V |
| ON | OFF | 900 V | 800 V |

Figure 7:
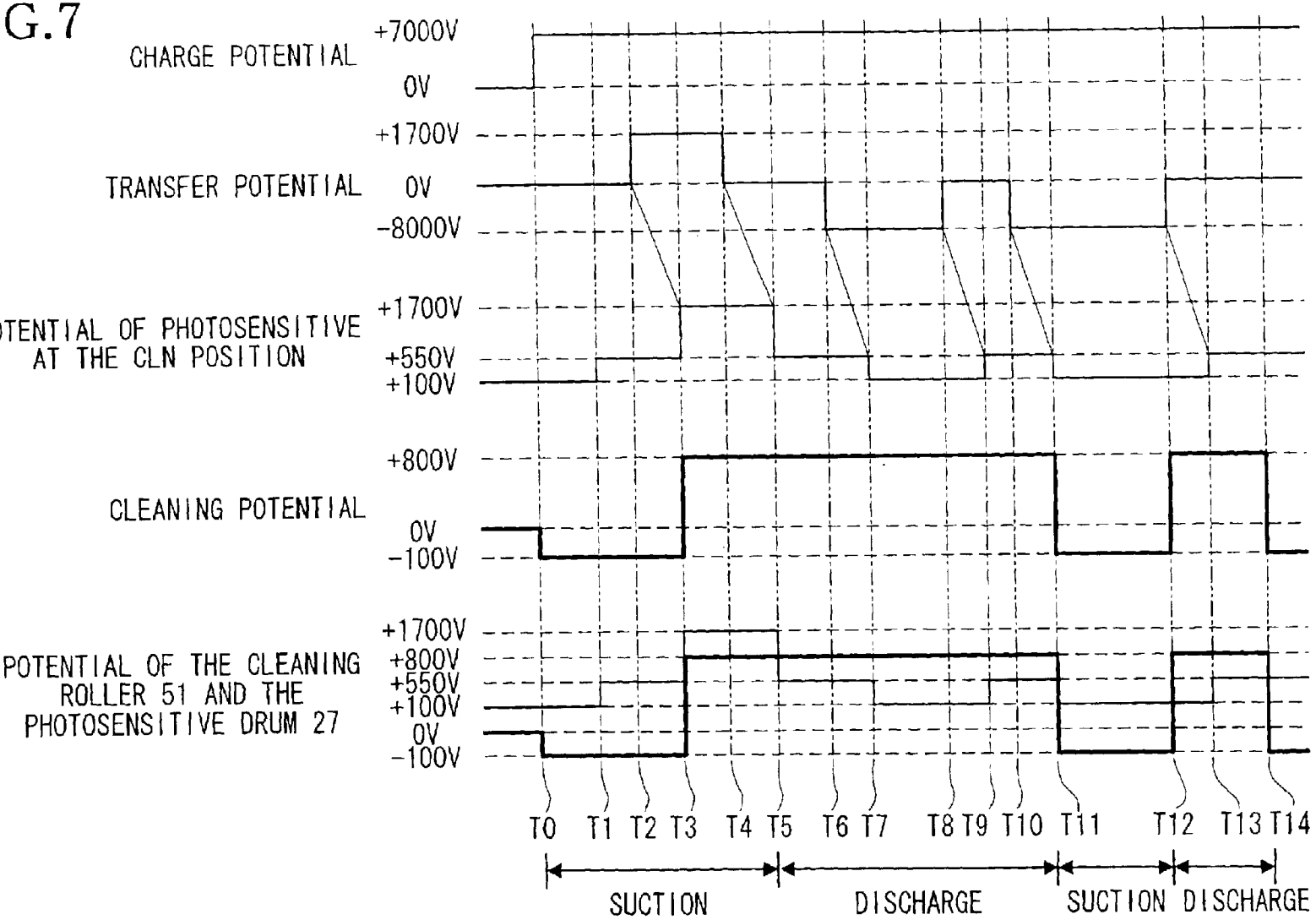
FIG. 7 is a timing chart showing timings of attraction or discharge of remaining toner by a cleaning roller.

With reference to FIGS. 3 and 7, timing when the cleaning roller 51 electrically attracts or discharges the remaining toner with respect to the photosensitive drum 27 will be explained. FIG. 7 is a timing chart showing the timing when the cleaning roller 51 attracts or discharges the remaining toner.

As shown in FIG. 3, the photosensitive drum 27 rotates in the clockwise direction at a constant speed. From the scorotron type charger 29 as a base point, the developing roller 31, the transfer roller 30 and the cleaning roller 51 are arranged along the rotational direction of the periphery of the photosensitive drum 27. In the laser printer 1, prior to the image forming operation, the toner removed by the cleaning roller and remaining on the surface of the cleaning roller 51 or the toner adhered on the transfer roller 30 is cleaned and the paper powder is removed.

As shown in FIG. 7, the charge bias of approximately 700V is applied from the high voltage generation circuit 200 to the charge electrode 29*a* of the scorotron type charger 29 at TO timing. Hereinafter, the potential of the charge electrode 29*a* is referred as charge potential.

When the charge bias is applied, the stable grid bias of approximately 1000V is applied to the photosensitive drum 27 by the grid electrode 29*b* and the surface potential of the photosensitive drum 27 is approximately 1000V. However, at the T0 timing, the surface potential of the photosensitive drum 27 at the contact position (CLN position) where the photosensitive drum 27 and the cleaning roller 51 are contacted with each other is approximately 100V.

The surface portion of the charged photosensitive drum 27 is rotated and reaches the CLN position at T1 timing that is delayed from the T0 timing. The surface potential of the photosensitive drum 27 is dropped by contacting the developing roller 31 during its rotation and the potential of the photosensitive drum 27 at the CLN position is approximately 550V.

On the other hand, the SW1 is off and the potential of the secondary roller 52 is approximately 0V at the T0 timing. As a result, the potential of the cleaning roller 51 (cleaning potential) is approximately −100V by the voltage generation circuit 300.

The surface potential of the photosensitive drum 27 is approximately 100V, while the cleaning potential at the timing T0–T1 is approximately −100V. The surface potential of the photosensitive drum 27 is approximately 550V, while the cleaning potential at the timing T1 is approximately −100V. Because the cleaning potential is lower than the surface potential of the photosensitive drum 27 during the timing T0–T2, the remaining toner on the photosensitive drum 27 is electrically attracted by the cleaning roller 51.

Next, the high voltage generation circuit 200 applies the inverse transfer bias of approximately 1700V to the transfer roller 30. Hereinafter, the potential of the transfer roller 30 is referred as transfer potential. The voltage of approximately 1700V is applied to the photosensitive drum 27 from the transfer roller 30 that contacts the photosensitive drum 27 and the charge potential of the portion of the photosensitive drum 27 that contacts the transfer roller 30 is approximately 1700V.

The inverse transfer bias is applied to carry out the cleaning operation of the transfer roller 30. In other words, the surface potential of the photosensitive drum 27 right before contacting the transfer roller 30 is approximately 550V. The transfer roller 30 is cleaned when the toner adhered on the surface of the transfer roller 30 moves to the surface of the photosensitive drum 27 in contact with the transfer roller 30.

The charge potential of the surface of the photosensitive drum 27 is approximately 1700V when contacting the transfer roller 30. The surface of the photosensitive drum 27 having approximately 1700V reaches the CLN position at T3 timing. After the application of the inverse transfer bias to the transfer roller 30 is completed at T4 timing, the surface potential of the photosensitive drum 27 is approximately 550V. The surface of the photosensitive drum 27 whose surface potential is approximately 550V reaches the CLN position at T5 timing.

In the switching circuit 500, the SW1 is on and the SW2 is off at timing T3. Then, the potential of the secondary roller 52 is approximately 900V and the cleaning potential is approximately 800V. Therefore, the cleaning potential is approximately −100V during T2–T3 timing, and the potential of the photosensitive drum 27 is approximately 550V. During T3–T5 timing, the cleaning potential is approximately 800V and the potential of the photosensitive drum 27 is approximately 1700V. Because the cleaning potential is lower than the surface potential of the photosensitive drum 27 during T2–T5 timing, the remaining toner on the photosensitive drum 27 is electrically attracted to the cleaning roller 51.

Next, the high voltage generation circuit 200 applies a regular transfer bias of approximately −8000V to the transfer roller 30 at T6 timing. Since the surfaces of the transfer roller 30 and the photosensitive drum 27 are contacted with each other, the voltage of −8000V is applied from the transfer roller 30 to the surface of the photosensitive drum 27. However, because the voltage drop circuit 400 applies the voltage to the positive charged photosensitive drum 27 so that the voltage of the photosensitive drum 27 is approximately 100V, the potential of the photosensitive drum 27 does not become lower than 100V. Therefore, the potential of the photosensitive drum 27 is approximately 100V at timing T7 when the surface of the photosensitive drum 27 that contacts the transfer roller 30 at timing T6 reaches the CLN position.

At timing T8, the application of the regular transfer bias to the transfer roller 30 is completed. At this point, the preparation operation prior to printing is completed. The surface potential of the photosensitive drum 27 is approximately 550V at timing T9 when the surface of the photosensitive drum 27 that contacts the transfer roller 30 where the application of the regular transfer bias is completed reaches the CLN position.

At timing T10, the high voltage generation circuit 200 applies the regular transfer bias of approximately −8000V to the transfer roller 30 again. At timing T10, the paper 3 is fed after starting the printing operation and reaches between the transfer roller 30 and the photosensitive drum 27. The potential of the photosensitive drum 27 is approximately 100V at timing T11 when the surface of the photosensitive drum 27 that contacts the transfer roller 30 at timing T10 reaches the CLN timing. On the other hand, the switching circuit 500 maintains the SW1 on and the SW2 off from timing T3 to timing T11. Accordingly, the cleaning potential is maintained approximately 800V from timing T3 to timing T11. The potential of the cleaning roller 51 is approximately 800V and the potential of the photosensitive drum 27 is approximately 550V during T5–T7 timing. The potential of the cleaning roller 51 is approximately 800V and the potential of the photosensitive drum 27 is approximately 100V during T7–T9 timing. The potential of the cleaning roller 51 is approximately 800V and the potential of the photosensitive drum 27 is approximately 550V during T9–T11 timing. The potential of the cleaning roller 51 is higher than the potential of the photosensitive drum 27 during each period of T5–T11 timing. Thus, during this period, the toner on the surface of the cleaning roller 51 is discharged to the surface of the photosensitive drum 27 that has lower potential.

Although not shown in the timing chart of FIG. 7, while the toner is discharged from the cleaning roller 51 to the photosensitive drum 27, the voltage is not applied to the developing roller 31. The potential of the developing roller 31 is approximately 0V and is lower than the potential of the photosensitive drum 27.

The toner that is discharged from the cleaning roller 51 and adhered on the surface of the photosensitive drum 27 faces the developing roller 31 and is charged by the scorotron type charge 29 according to the rotation of the photosensitive drum 27. The toner is transferred to the developing roller 31 according to the potential difference between the toner and the developing roller 31. In other words, the toner is returned to the process cartridge 17 having the developing roller 31. Thus, the toner that is not transferred to the paper 3 is returned to the process cartridge 17 to reuse it.

After timing T12, the cleaning potential is switched between approximately −100V and 800V according to the printing operation. When the printing operation is carried out, or when the transfer potential is −8000V, the SW1 is off to maintain the potential of the cleaning roller 51 at −100V. At this time, because the potential of the photosensitive drum 27 at the CLN position is approximately 100V, the toner adhered on the photosensitive drum 27 is attracted to the cleaning roller 51.

On the other hand, during idle operation or when the printing operation is not carried out, the transfer potential is 0V. The SW1 is on and the SW2 is off to maintain the potential of the cleaning roller 51 at approximately 800V. At this time, because the potential of the photosensitive drum 27 at the CLN position is approximately 550V, the toner attracted by the cleaning roller 51 is discharged to the photosensitive drum 27. However, the toner is not always discharged during the idle operation. At timing T14 or after a predetermined time has passed after the SW1 is on, the SW1 is off and the potential of the cleaning roller 51 is −100V to finish discharging the toner.

While the operations of attracting and discharging toner are carried out, the potential of the secondary roller 52 is always higher than the potential of the cleaning roller 51 by approximately 100V. The cleaning roller 51 contacts the photosensitive drum 27 to electrically attract and mechanically wipe the remaining toner or foreign matters (paper powder or other objects) adhered on the surface of the photosensitive drum 27. Since the toner is positively charged, the toner is not transferred to the secondary roller 52 that has a higher potential than the cleaning roller 51 and remains on the cleaning roller 51. Because the paper powder or other objects are normally negatively charged, they are transferred to the secondary roller 52. Since the paper powder adhered to the secondary roller 52 is mechanically removed by the wiping member 53, the secondary roller 52 is cleaned and the paper powder is not returned to the photosensitive drum 27.

As explained above, in the laser printer 1 of this embodiment, the voltage is supplied from the charge electrode 29*a* of the scorotron type charger 29 to each of the cleaning roller 51 and the secondary roller 52. In other words, the output of the high voltage generation circuit 200 for supplying the voltage to the charge electrode 29*a* is also supplied to the cleaning roller 51 and the secondary roller 52. Therefore, a special electric source for supplying the voltage to the cleaning roller 51 and the secondary roller 52 is not necessary.

When the voltage is supplied to the cleaning roller 51 or the secondary roller 52, the voltage generation circuit 300 always maintains the potential of the secondary roller 52 higher than the potential of the cleaning roller 51 by approximately 100V.

The voltage drop circuit 400 always applies the voltage of approximately 100V to the photosensitive drum 27. When the switching circuit 500 switches the potential of the secondary roller 52, the potential of the cleaning roller 51 is switched. The toner or foreign matters on the photosensitive drum 27 is transferred to the cleaning roller 51 at the printing operation according to the relation between the potential of the photosensitive drum 27 and the potential of the cleaning roller 51. The toner on the cleaning roller 51 is returned to the photosensitive drum 27 and collected by the developing roller 31 at the idle operation or the printing preparation T0–T11 shown in FIG. 7.

While the invention has been described in detail and with reference to the specific embodiments thereof, it would be apparent to those skilled in the art that various changes, arrangements and modifications may be applied therein without departing from the spirit and scope of the invention.

Figure 8:
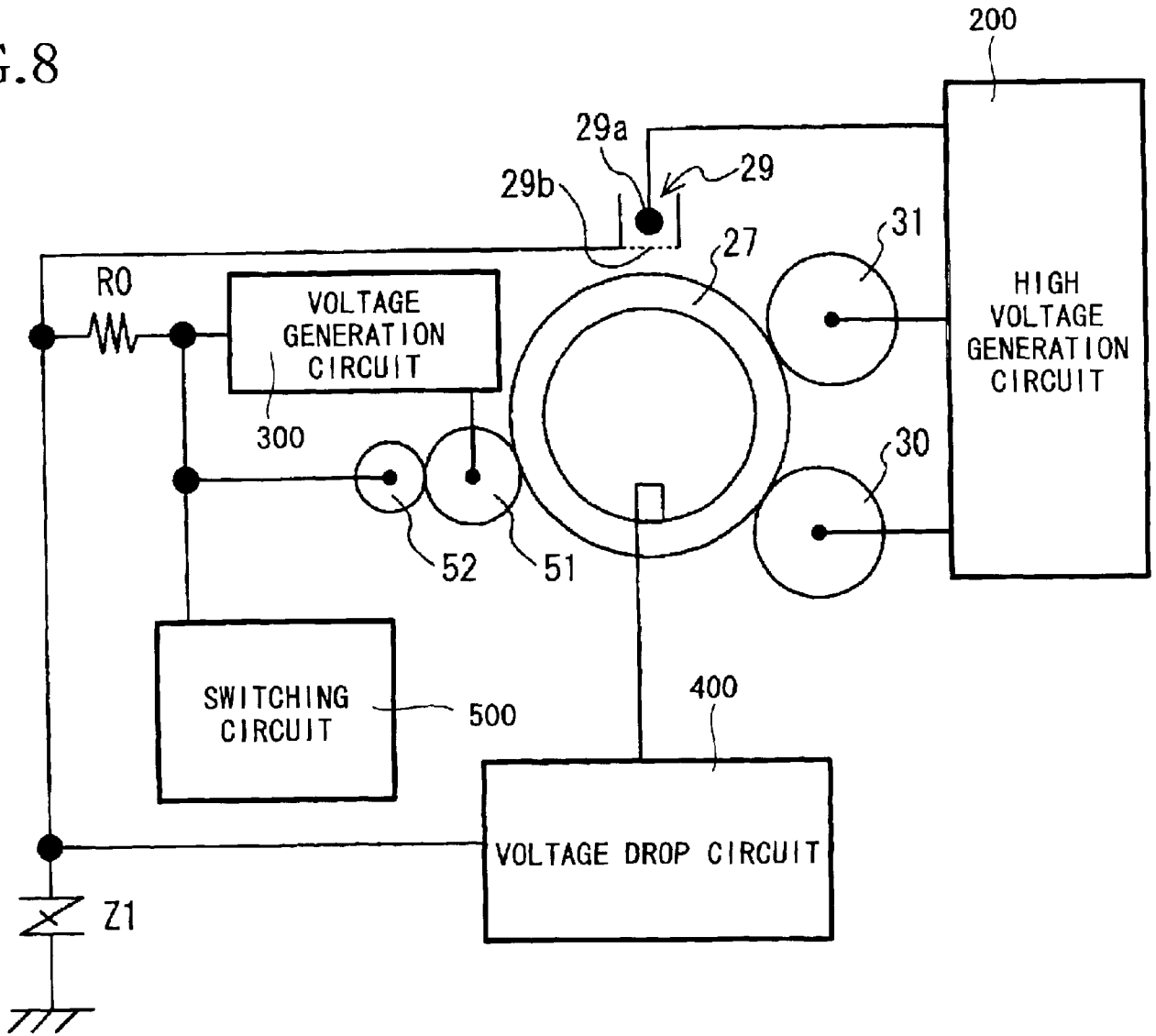
FIG. 8 is a block diagram showing a modified example of an electric structure in a vicinity of the cleaning mechanism.

For example, as shown in FIG. 8, the voltage applied to the cleaning roller 51 and the secondary roller 52 may be supplied from the grid electrode 29*b* of the scorotron type charger 29. The grid electrode 29*b* is earthed via the varistor Z1 and maintained at the voltage of approximately 1000V. The grid electrode 29*b* is connected to the secondary roller 52, the voltage generation circuit 300 and the switching circuit 500 via the resistor R0. In this case also, the cleaning operation for cleaning the remaining toner or paper powder on the photosensitive drum 27 is same as the above-described embodiment.

Figure 9:
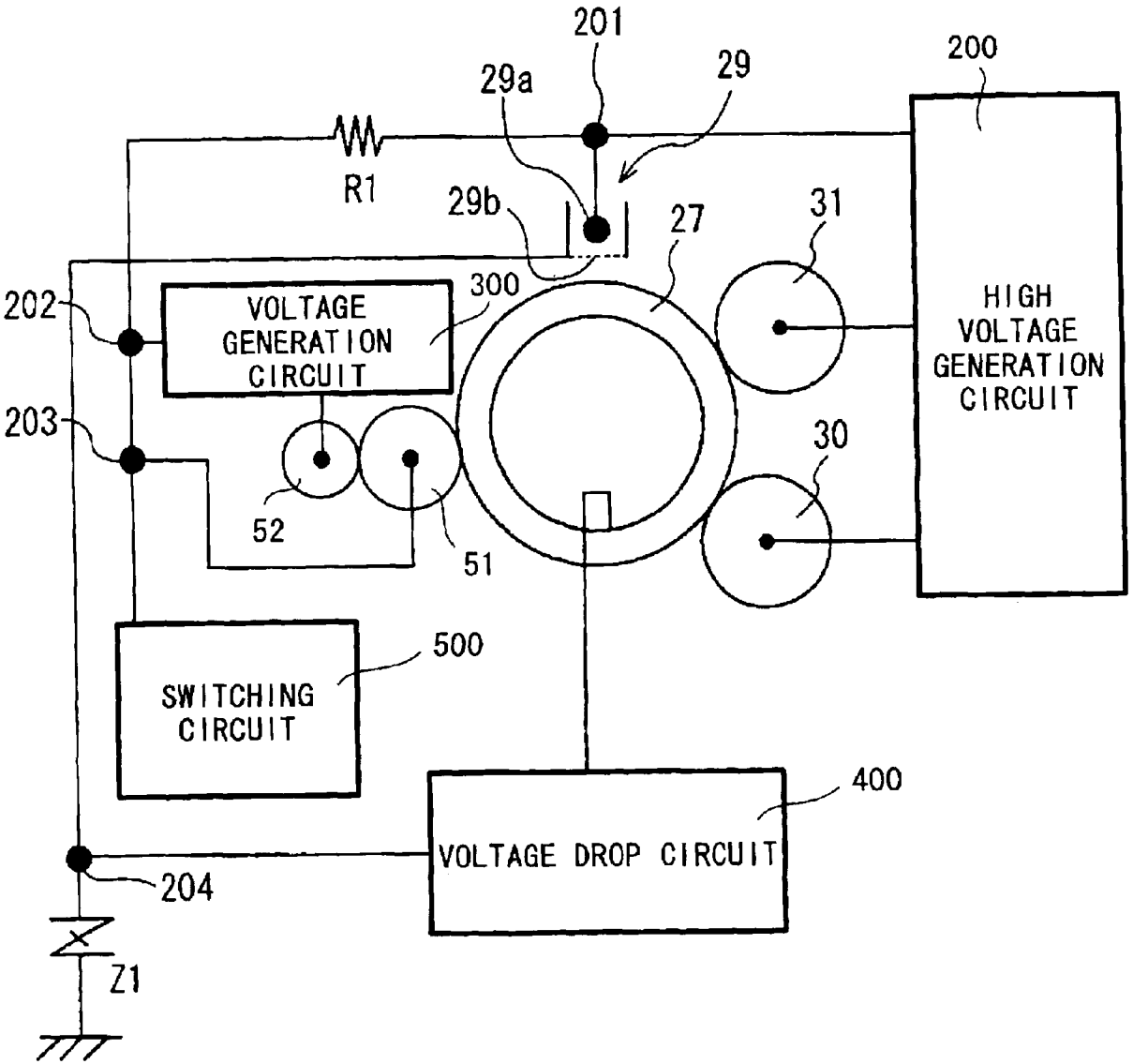
FIG. 9 is a block diagram showing a modified example of an electric structure in a vicinity of the cleaning mechanism.
Figure 10:
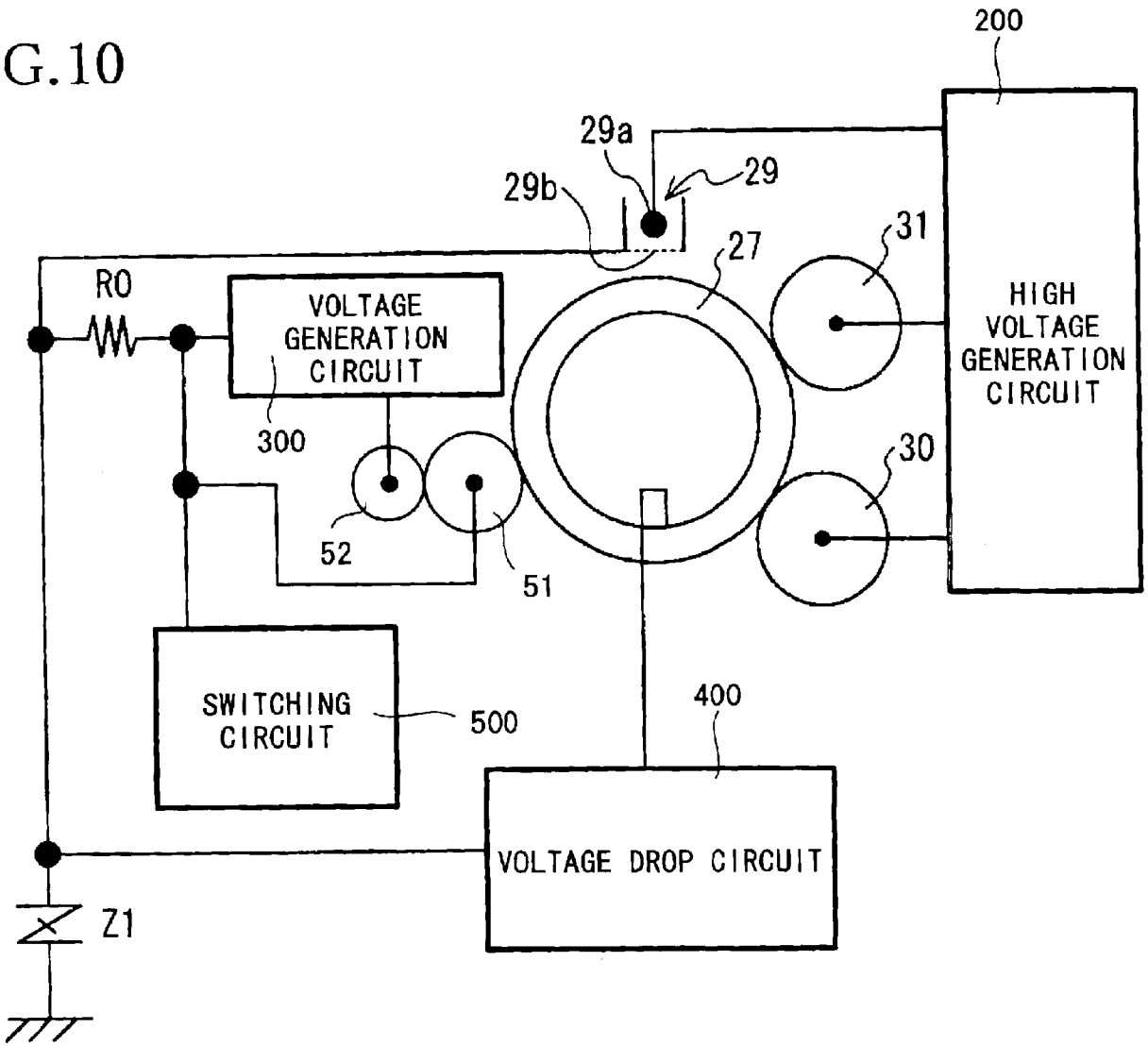
FIG. 10 is a block diagram showing a modified example of an electric structure in a vicinity of the cleaning mechanism

As shown in FIG. 9, the voltage supplied from the charge electrode 29*a* may be also applied to the cleaning roller 51. As shown in FIG. 10, the voltage supplied from the grid electrode 29*b* may be also applied to the cleaning roller 51. In this case, the voltage generation circuit 300 maintains the potential of the secondary roller 52 higher than the potential of the cleaning roller 51 by approximately 100V.

The potential difference between the secondary roller 52 and the cleaning roller 51 made by the voltage generation circuit 300 is not necessarily approximately 100V and may be approximately −50V or −200V. The voltage that is always applied to the photosensitive drum 27 by the voltage drop circuit 400 is not necessarily approximately 100V and may be approximately 50V or 200V. In the circuit shown in FIG. 3, the voltage applied to the photosensitive drum 27 is supplied from the grid electrode 29*b*. The voltage applied to the photosensitive drum 27 may be supplied from the charge electrode 29*a*.

In the above embodiment, the positively charged toner is used as a developer. The negatively charged toner may be used. In this case, the voltage applied to each component is set so that the relation of the voltage of each component is relatively reversed. Or the polarity of the voltage applied to each component may be reversed.

What is claimed is:

1. An image forming apparatus, comprising:

a photosensitive member that holds an image formed by a developing agent;

a scanner unit that scans a laser beam on a surface of the photosensitive member in order to from the image onto the photosensitive member;

a charging device that is disposed along the surface of the photosensitive member upstream, along a rotating direction of the photosensitive member, from a scanning area where the laser beam is scanned on the surface and that charges the surface of the photosensitive member;

a voltage applying device that applies a voltage to the charging device;

a first cleaning element that is disposed along the surface of the photosensitive member upstream, along the rotating direction of the photosensitive member, from the charging device and that contacts the surface of the photosensitive member, wherein the charging device is between the first cleaning element and the scanning area along the surface of the photosensitive member;

a second cleaning element that contacts a surface of the first cleaning member; and a first voltage controlling device, connected to the charging device, the first cleaning element and the second cleaning element, that generates a predetermined potential difference between the first cleaning element and the second cleaning element based on the voltage applied to the charging device.

2. The image forming apparatus according to claim 1, wherein the charging device includes a charging electrode and a grid electrode, and the first voltage controlling device is connected to the grid electrode.

3. The image forming apparatus according to claim 1, wherein the charging device includes a charging electrode and a grid electrode, and the first voltage controlling device is connected to the charging electrode.

4. The image forming apparatus according to claim 1, further comprising:

a second voltage controlling device, connected to the charging device and the photosensitive member, that applies a predetermined voltage to the photosensitive member based on the voltage applied to the charging device.

5. The image forming apparatus according to claim 4, wherein the developing agent is positively charged and a potential of the first cleaning element is lower than a potential of the photosensitive member such that the developing agent and foreign matters on the photosensitive member are transferred to the first cleaning member.

6. The image forming apparatus according to claim 5, wherein a potential of the second cleaning element is higher than the potential of the first cleaning element such that the foreign matters are transferred from the first cleaning element to the second cleaning element.

7. The image forming apparatus according to claim 6, wherein the potential of the first cleaning member is higher than the potential of the photosensitive member such that the developing agent on the first cleaning element is transferred to the photosensitive member.

8. The image forming apparatus according to claim 7, wherein the developing agent, which is transferred to the photosensitive member, is further transferred to a developing roller.

9. The image forming apparatus according to claim 4, further comprising:

a third voltage controlling device, connected to the second cleaning element, that switches a voltage applied to the second cleaning voltage.

10. The image forming apparatus according to claim 1, further comprising:

a removing member that contacts a surface of the second cleaning element.

11. An image forming apparatus, comprising:

a photosensitive member that holds an image formed by a developing agent;

a charging device that charges a surface of the photosensitive member;

a voltage applying device that applies a first voltage to the charging device;

a first cleaning element provided at the surface of the photosensitive member;

a first voltage controlling device, connected to the charging device and the first cleaning element, that applies a second voltage to the first cleaning element based on the first voltage applied to the charging device; and a second voltage controlling device, connected to the charging device and the photosensitive member, that applies a third voltage to the photosensitive member based on the first voltage applied to the charging device such that a potential difference is generated between the photosensitive member and the first cleaning element.

12. The image forming apparatus according to claim 11, wherein the charging device includes a charging electrode and a grid electrode, and each of the first voltage controlling device and the second voltage controlling device is connected to the grid electrode.

13. The image forming apparatus according to claim 11, wherein the charging device includes a charging electrode and a grid electrode, and each of the first voltage controlling device and the second voltage controlling device is connected to the charging electrode.

14. The image forming apparatus according to claim 11, further comprising:

a second cleaning element that contacts a surface of the first cleaning element, wherein the second voltage controlling device is also connected to the second cleaning element and applies to the second cleaning element a fourth voltage such that a predetermined potential difference is generated between the first cleaning element and the second cleaning element.

15. The image forming apparatus according to claim 14, wherein the developing agent is positively charged and a potential of the first cleaning element is lower than a potential of the photosensitive member such that the developing agent and foreign matters on the photosensitive member are transferred to the first cleaning member.

16. The image forming apparatus according to claim 15, wherein a potential of the second cleaning element is higher than the potential of the first cleaning element such that the foreign matters are transferred from the first cleaning element to the second cleaning element.

17. The image forming apparatus according to claim 16, wherein the potential of the first cleaning member is higher than the potential of the photosensitive member such that the developing agent on the first cleaning element is transferred to the photosensitive member.

18. The image forming apparatus according to claim 17, wherein the developing agent, which is transferred to the photosensitive member, is further transferred to a developing roller.

19. The image forming apparatus according to claim 14, further comprising:

a third voltage controlling device, connected to the second cleaning element, that switches a voltage applied to the second cleaning voltage.

20. The image forming apparatus according to claim 11, further comprising:

a removing member that contacts a surface of the second cleaning element.

* * * * *